US005342167A

United States Patent [19]

Rosseau

[11] Patent Number: 5,342,167

[45] Date of Patent: Aug. 30, 1994

[54] LOW NOISE FAN

[75] Inventor: Todd D. Rosseau, Ann Arbor, Mich.

[73] Assignee: Airflow Research and Manufacturing Corporation, Watertown, Mass.

[21] Appl. No.: 959,250

[22] Filed: Oct. 9, 1992

[51] Int. Cl.[5] ..... F04D 29/66

[52] U.S. Cl. ..... 415/119; 415/195; 415/208.2; 415/211.2; 415/220

[58] Field of Search ..... 415/119, 185, 191, 194, 415/195, 208.1, 208.2, 209.2, 210.1, 211.2, 220

[56] References Cited

U.S. PATENT DOCUMENTS

| | | | |
|---|---|---|---|
| 2,636,668 | 4/1953 | Meyer et al. . | |
| 3,125,284 | 3/1964 | Lawler . | |
| 3,194,487 | 7/1965 | Tyler et al. | 415/119 |
| 3,572,962 | 3/1971 | Embleton et al. . | |
| 3,610,262 | 10/1971 | Wise . | |
| 3,700,358 | 10/1972 | Papst et al. . | |
| 3,820,628 | 6/1974 | Hanson . | |
| 3,850,544 | 11/1974 | Ciokajlo . | |
| 3,873,220 | 3/1975 | Kashiwabara . | |
| 4,086,761 | 5/1978 | Schaut et al. . | |
| 4,131,387 | 12/1978 | Kazin et al. | 415/119 |
| 4,155,221 | 5/1979 | Dhoore et al. . | |
| 4,156,344 | 5/1979 | Cuthbertson et al. . | |
| 4,255,083 | 3/1981 | Andre et al. . | |
| 4,419,045 | 12/1983 | Andre et al. . | |
| 4,427,328 | 5/1990 | Scoates et al. | 415/220 |
| 4,482,302 | 11/1984 | Grignon | 415/220 |
| 4,548,548 | 10/1985 | Gray, III . | |
| 4,569,632 | 2/1986 | Gray, III . | |
| 4,636,669 | 1/1987 | Plunkett et al. . | |
| 4,761,115 | 8/1988 | Hopfensperger . | |
| 4,772,192 | 9/1988 | Wilfried . | |
| 4,773,828 | 9/1988 | Hagiwara et al. . | |
| 4,828,468 | 5/1989 | Sipe et al. . | |
| 4,895,501 | 1/1990 | Bagepalli . | |
| 4,960,372 | 10/1990 | Scheldorf et al. . | |

FOREIGN PATENT DOCUMENTS

| | | | |
|---|---|---|---|
| 3614806 | 11/1986 | Fed. Rep. of Germany | 415/119 |
| 2470879 | 6/1981 | France | 415/119 |

*Primary Examiner*—Edward K. Look
*Assistant Examiner*—Christopher Verdier
*Attorney, Agent, or Firm*—Fish & Richardson

[57] ABSTRACT

An axial flow fan includes blades mounted on a hub and extending radially outward to a shroud disposed around the hub. Pairs of stators are connected to the shroud at positions angularly spaced about the inner periphery of the shroud. Each pair of stators includes a trailing stator angularly spaced from a leading stator by a distance related to the number of blades of the cooling fan. A trailing stator of one pair is spaced from a leading stator of an adjacent pair by a distance different than the distance between leading and trailing stators of each pair.

4 Claims, 4 Drawing Sheets

SIX PAIRED STATORS

SEVEN PAIRED STATORS

TWELVE EVEN STATORS

LOW NOISE FAN

BACKGROUND OF THE INVENTION

This invention relates to axial flow fans, for example, fans designed for use in automobiles or heating, ventilation and air conditioning (HVAC) systems.

Axial flow fans for producing flow are employed in a wide variety of applications. For example, a fan is placed within the engine compartment of an automobile to move air through a radiator. When the automobile is operating, particularly at low speeds or idling, noise generated by the fan can be heard by the occupants within as well as by those outside the automobile. In this application it is desirable to provide a fan that is strong (sufficient airflow), compact (due to space limitations) and relatively quiet.

One type of axial flow fan includes a number of blades, each having a root end secured to a hub that is driven by a rotating shaft of an electric motor and from which the blades extend radially outward. The blades may be of any suitable design, but are generally "pitched" at an angle to the plane of the fan rotation to generate an axial air flow as the blades rotate.

The electric motor is secured within a cylindrical band known as a motor ring with the rotating shaft coaxial with the ring. A number of vane members or stators extend from the motor ring to a second cylindrical housing or shroud to provide structural support to the electrical motor during operation.

The interaction of the rotating blades with the fixed stators generates noise in the audible range of the human ear called blade rate tones. Blade rate tones and their harmonics are generated when a blade passes over a stator at any given time. The blade rate tone has a frequency proportional to the product of the number of blades and the rotational velocity of the fan. When more than one blade passes over a stator at the same time, the blade rate tones are said to "stackup" causing their magnitude to increase.

SUMMARY OF THE INVENTION

One general aspect of the invention is a fan including a hub rotatable on an axis and blades secured to the hub, each blade extending radially outward from the hub to a blade tip. The fan further includes an inner ring coaxial with the axis having a portion axially offset from the hub and a shroud disposed around the blade tips. Stators extend radially from the inner ring to the shroud with the members paired, each pair having a leading stator and a trailing stator angularly spaced by a distance related to the number of blades. A trailing stator of one pair is spaced from a leading stator of an adjacent pair by a distance different than the distance between leading and trailing members of each pair.

Embodiments of the invention include the following features.

The spacing between the leading and trailing stators is equal to one-half the wavelength associated with the frequency of the blade rate tone generated by the blades passing over the stators. The angular spacing between the leading and trailing stators has a value equal to (360 degrees ÷ the number of blades) ÷ 2. In one embodiment leading stators are equally spaced from one pair to an adjacent stator pair, while in another embodiment the spacing between leading stators are not equally spaced from one pair to an adjacent stator pair.

A low noise fan is provided by arranging the stators of the fan motor support structure in pairs. The stators of each pair are angularly spaced such that a portion of the overall noise, called blade rate tones, is reduced. Blade rate tones are generated by the blades passing over the stators. By appropriately spacing each stator of each pair by one half the wavelength associated with the frequency of the blade rate tone, the blade rate tones are substantially reduced. The angular spacing being equal to one half the wavelength of the blade rate tone provides for the generation of sound pressure waves for each stator which are substantially equal in magnitude but 180° out of phase. The out of phase pressure waves destructively interfere and cancel. It should be noted that although the frequency of the blade rate tone changes with the speed of the motor, the stator pairs will always be angularly spaced by one half the wavelength related to the changing frequency. Accordingly, the generated tones will always be out of phase by 180° and will cancel. Reduction in the magnitude of the blade rate tones is provided by spacing the stators of each pair and, to the extent that stack up is avoided, is independent of the spacing between the pairs.

Other advantages and features of the invention will be apparent from the following description and from the claims.

DESCRIPTION OF THE PREFERRED EMBODIMENTS

Figure 1:
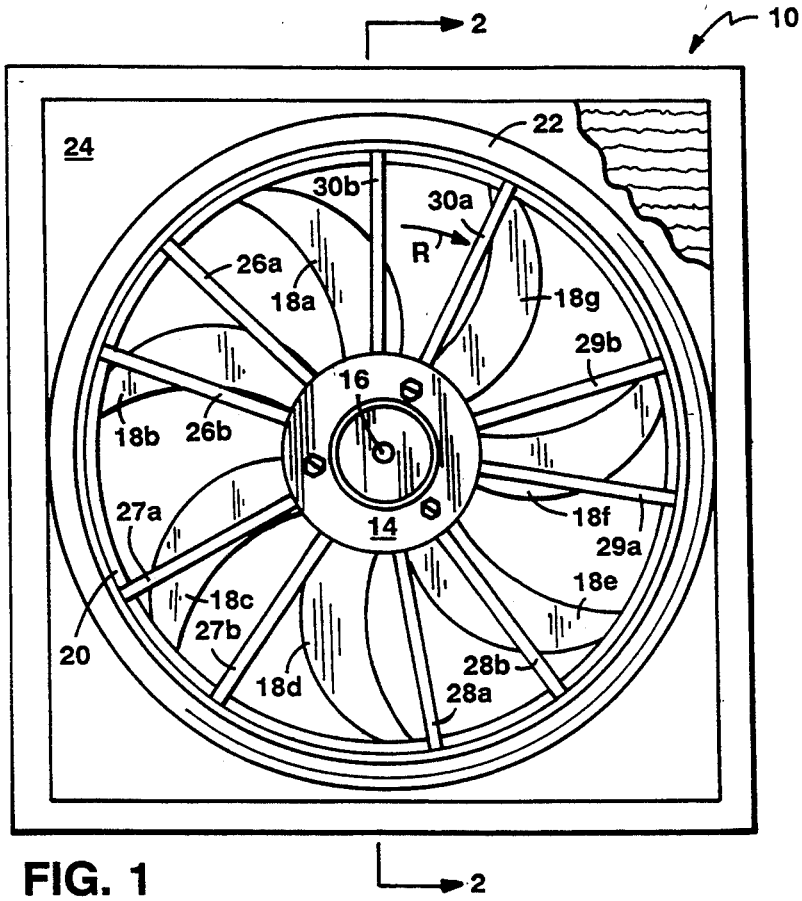
FIG. 1 is a rear view of a fan according to the invention.
Figure 2:
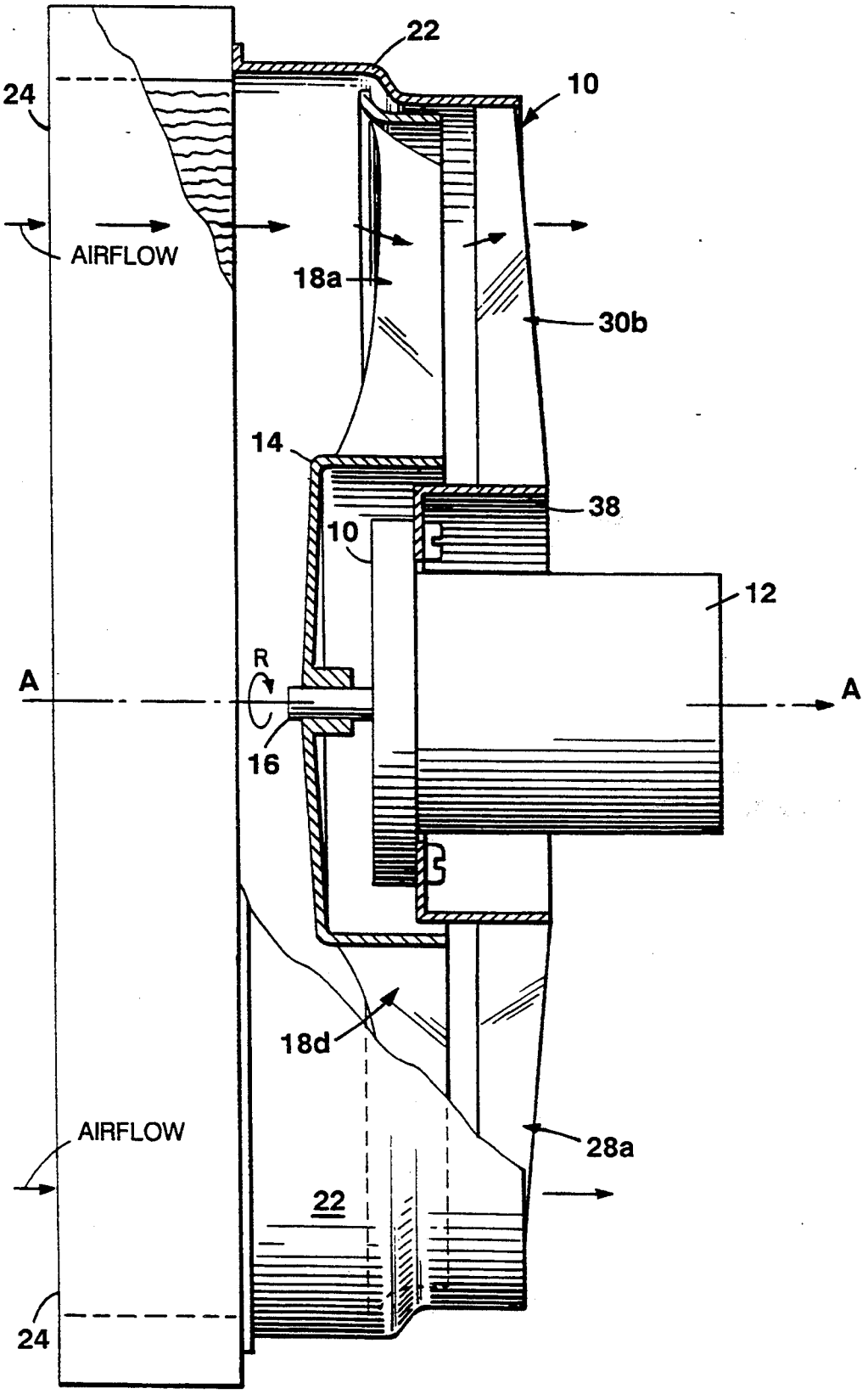
FIG. 2 is a side view, partially in section, taken along lines 2—2 of FIG. 1.

As shown in FIGS. 1 and 2, an automobile cooling fan 10 includes an electric motor 12 connected to the center of a cylindrical fan hub 14 through a shaft 16. Fan 10 includes seven blades 18*a*–18*g* each having a root end secured to hub 14 and extending radially outward toward a circumferential band 20. Blades 18*a*–18*g* may be of any suitable design including blades as described in U.S. Pat. No. 4,569,632, hereby incorporated by reference. Fan 10 has an axis indicated by arrow A and is designed to rotate blades 18*a*–18*g* in the direction indicated by arrow R.

The tips of blades 18*a*–18*g* are attached to circumferential band 20 which is concentric about axis A. A shroud 22 is disposed around electric motor 12 and extends axially from the circumference of a radiator 24 to a position rearward of the plane of blades 18*a*–18*g*. Pairs of stator members 26*a*–30*a* and 26*b*–30*b* extend radially inward from shroud 22 to a cylindrical motor mount 38 positioned coaxially with fan 10 to shroud 22. The stator members provide structural support to the vibrating fan motor 12 in operation.

The five stator member pairs 26a–30a and 26b–30b are equally spaced from an adjacent one by an angular distance of 72° which is determined simply by dividing the number of stator pairs into 360°. The number of stator pairs selected is generally dependent upon the structural support needed for shroud 22 and to avoid stackup of blade rate tones. It should be noted that fan 10 has ten stator members (five pairs) and seven blades 18a–18g in order to prevent "stackup" of blade rate tones. "Stackup", which increases the noise output of the fan, occurs when the number of stator members equals an even multiple of the number of fan blades used.

Each stator member pair has a leading stator 26a–30a and a trailing stator 26b–30b having an angular spacing therebetween of 25.71°. The angular spacing is determined by the following relationship:

$$\Theta \text{ (in degrees)} = 360°/(\text{blade number})/2$$

In operation, as each blade 18a–18g passes over a leading stator 26a–30a, a sound pressure wave is generated having a frequency equal to the product of the number of blades and the rotational velocity of the fan measured in revolutions/second. As each blade 18a–18g then passes over the associated trailing stator 26b–30b, a second pressure wave is generated substantially equal in amplitude and a half wavelength (or 180°) behind the wave generated by the leading stator 26a–30a. The superposition of two pressure waves spaced in this manner destructively interfere and effectively cancel the generated blade rate tone.

Figure 3A:
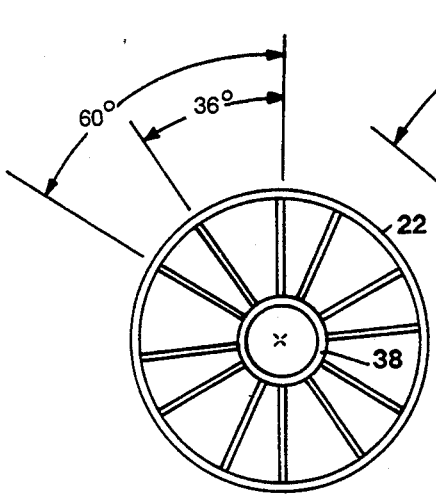
FIGS. 3*a*—3*b* show various arrangements of a support structure of the fan according to the invention.
Figure 3B:
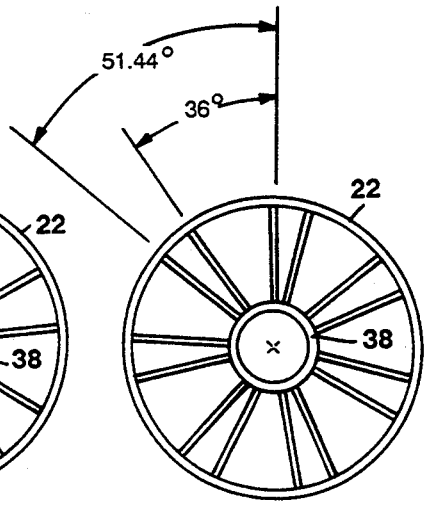
Figure 3C:
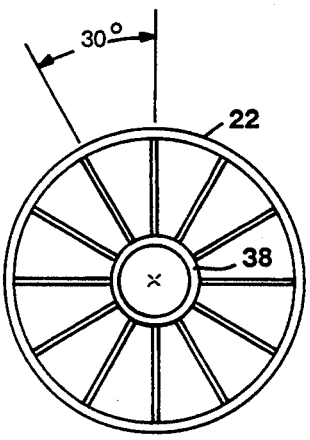
PRIOR ART FIG. 3c
FIG. 3*c* shows a prior art support structure arrangement.

Referring to FIGS. 3a and 3b, support structures 40 having other stator arrangements are shown for a five blade fan system. Using the relationship above, it is determined that the proper angular spacing for a fan with five blades is 36°, independent of the number of stator pairs. The spacing between stator pairs however becomes smaller as the number of stator pairs increases. As is shown in FIG. 3b, the spacing between seven pairs of stators is 51.44° as compared to a 60° spacing for a six pair stator arrangement. FIG. 3c shows a support structure 40 without the local pairing of stators but having the same number of stators as is used in the arrangement of FIG. 3a. In this arrangement, the twelve stators are evenly spaced by 30°.

Figure 4A:
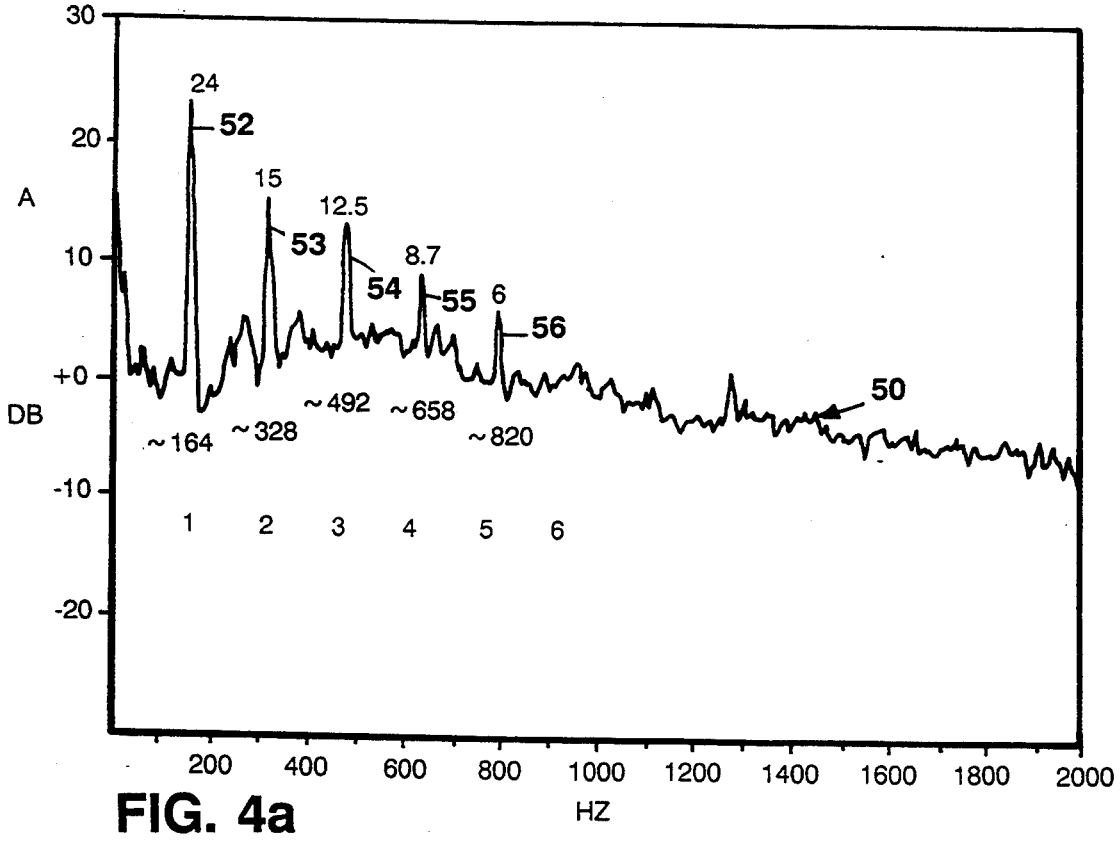
FIG. 4*a* is a graph of blade rate tone amplitude versus frequency in conjunction with the prior art fan support structure of FIG. 3*c*.

Although the noise produced by blade rate tones is only a portion of the overall noise generated by fan 10, its contribution can be particularly offensive when blade rate tones are generally below 2 kilohertz. The human ear in this frequency range has greater sensitivity to tones than at higher frequencies within the audible range of the ear. As is shown in FIG. 4a, curve 50 represents a relative noise output characteristic (Y-axis) in units of A weighted decibels (dBA) as a function of frequency in Hz (X-axis) for a five bladed fan system having twelve stators as shown in FIG. 3c. Spiked portions 52–56 represent blade rate tones at fundamental and harmonically related frequencies.

Figure 4B:
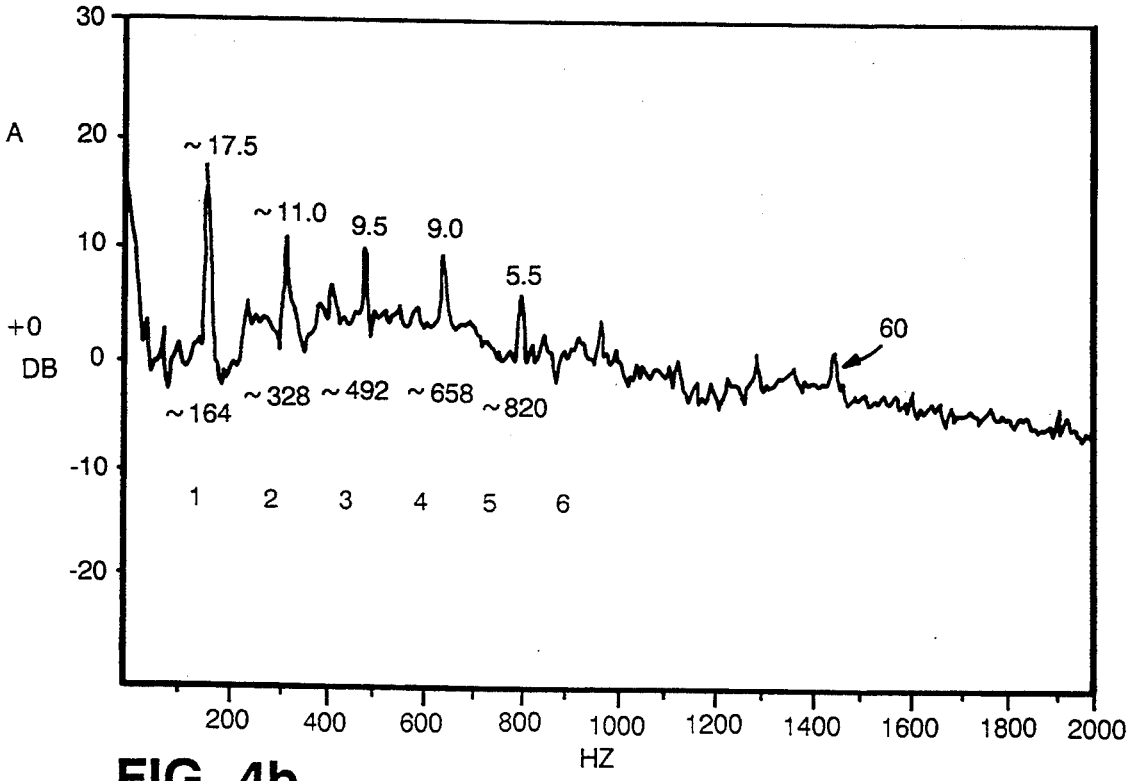
FIG. 4*b* is a graph of blade rate tone amplitude versus frequency in conjunction with the fan support structure of FIG. 3*a*.

Referring to FIG. 4b, curve 60 represents a five bladed system having twelve stators which are paired in accordance with the present invention (See FIG. 3a). As indicated in the table below, the blade rate tones at the fundamental, as well as higher multiples of the fundamental, are reduced for the stator arrangement in which the stators are paired to generate destructive interference. For example, the blade rate tone has been substantially reduced by 6.5 db at the fundamental frequency of 164 Hz.

| Harmonic | 6 Paired Stators | 12 Stators |
|---|---|---|
| 1 | 17.5 | 24.0 |
| 2 | 11.0 | 15.0 |
| 3 | 9.5 | 12.5 |
| 4 | 9.0 | 8.7 |
| 5 | 5.5 | 6.0 |
| 6 | 3.0 | 2.0 |

Figure 5:
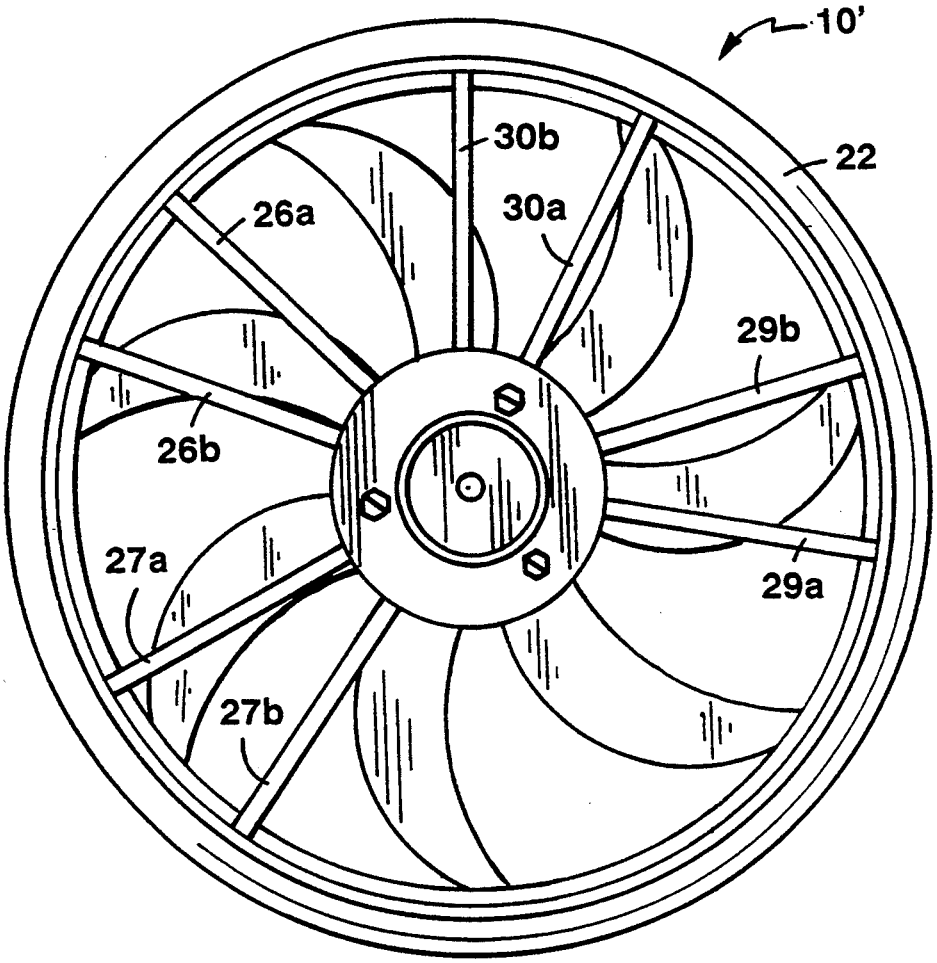
FIG. 5 is a diagrammatic view of an asymmetric support structure arrangement.

Referring to FIG. 5, an alternate embodiment of a fan 10' similar to the seven blade fan of FIGS. 1 and 2 is shown having one of the five stator pairs 26a–30a and 26b, 30b removed. It is not uncommon to move or remove stators because of space limitations or to provide clearance for other hardware adjacent to the fan. Nevertheless, removing stator pairs or the angular spacing between them does not diminish the effectiveness in reducing the magnitude of blade rate tones by properly spacing the leading and trailing stators of each pair. Provided the repositioned or removed stators do not provide a stackup condition, blade rate tones will still be effectively reduced.

While the invention has been described with respect to a preferred embodiment, it should be understood that various alterations, modifications and applications are possible without departing from the scope of the present invention. For example, although the invention has been described with respect to the movement of air, the invention is equally applicable in environments where fluids are to be moved.

What is claimed is:

1. A fan comprising:

a hub rotatable on an axis;

blades secured to said hub, each blade extending radially outward from said hub to a blade tip;

an inner ring coaxial with said axis having a portion axially offset from said hub;.

a shroud disposed around said blade tips;.

stators extending radially from said inner ring to said shroud, a first one of the stators being angularly spaced from a second one of the stators so that a first acoustic wave generated by one of the blades passing over the first one of the stators is substantially cancelled by a second acoustic wave generated by said one of the blades passing over the second one of said stators, wherein said stators comprise pluralities of paired first and second stators, each pair comprising one of the plurality of first stators and a corresponding one of the plurality of second stators, the plurality of first stators being leading stators and the plurality of second stators being trailing stators, the leading and trailing stator of each pair angularly spaced from each other by a first distance, the trailing stator of each pair of stators being angularly spaced by a second distance from a leading stator of an adjacent stator pair, said first and second distances being different from one another and selected so that acoustic waves generated by a fan blade passing over the leading and trailing stators of each pair have a phase difference of 180°.

2. A fan comprising:

a hub rotatable on an axis:

blades secured to said hub, each blade extending radially outward from said hub to a blade tip;

an inner ring coaxial with said axis having a portion axially offset from said hub;

a shroud disposed around said blade tips;

stators extending radially from said inner ring to said shroud, said stators being paired, each pair having a leading stator and a trailing stator angularly spaced by a distance related to the number of said blades, a trailing stator of one pair spaced from a leading stator of an adjacent pair by a distance different than said distance between leading and trailing stators of each pair, wherein said distance between each leading and trailing stator has a value equal to (360 degrees ÷ the number of said blades) ÷ 2.

3. The fan of claim 2 wherein each leading stator is equally spaced from the leading stator of an adjacent stator pair.

4. The fan of claim 2 wherein each leading stator is not equally spaced from the leading stator of an adjacent stator pair.

* * * * *

UNITED STATES PATENT AND TRADEMARK OFFICE

CERTIFICATE OF CORRECTION

PATENT NO. : 5,342,167

DATED : August 30, 1994

INVENTOR(S) : Todd D. Rosseau

It is certified that error appears in the above-identified patent and that said Letters Patent is hereby corrected as shown below:

On the title page, item [56]

In the references cited section, "4,427,328 Scoates et al." should be --4,927,328 Scoates et al.--.

Signed and Sealed this

Twelfth Day of December, 1995

*Attest:*

*Attesting Officer*

BRUCE LEHMAN

*Commissioner of Patents and Trademarks*